US006550187B1

(12) United States Patent
Petric

(10) Patent No.: US 6,550,187 B1
(45) Date of Patent: Apr. 22, 2003

(54) MARKETABLE OBJECT FOR SELLING ICE CREAM, WITH REFRIGERATING SHOWCASE, SUNSHADE AND CHAIR

(76) Inventor: Srecko Petric, Doverska 29, 21000 Split (HR)

( * ) Notice: Subject to any disclaimer, the term of this patent is extended or adjusted under 35 U.S.C. 154(b) by 0 days.

(21) Appl. No.: 09/509,660

(22) PCT Filed: Jul. 29, 1999

(86) PCT No.: PCT/HR99/00016

§ 371 (c)(1),
(2), (4) Date: Mar. 30, 2000

(87) PCT Pub. No.: WO00/06855

PCT Pub. Date: Feb. 10, 2000

(30) Foreign Application Priority Data

Jul. 30, 1998 (HR) ..... P980424A

(51) Int. Cl.[7] ..... A47F 10/00

(52) U.S. Cl. ..... 52/36.1; 52/36; D25/10; D25/16; D13/1

(58) Field of Search ..... 52/36.1, 36.2; D25/10

(56) References Cited

U.S. PATENT DOCUMENTS

| | | | | | |
|---|---|---|---|---|---|
| D75,511 | S | * | 6/1928 | Natzel | |
| 1,713,050 | A | * | 5/1929 | Natzel et al. | |
| D78,897 | S | * | 7/1929 | Peterson | |
| 1,861,405 | A | * | 5/1932 | Brantferger | |
| D167,378 | S | * | 7/1952 | Shank | D13/1 |
| D205,283 | S | * | 7/1966 | Kohner | D13/1 |
| 4,270,319 | A | * | 6/1981 | Spasojevic | 52/36 |
| D288,486 | S | * | 2/1987 | Skinner | D25/10 |
| D358,661 | S | * | 5/1995 | Chinnis et al. | D25/16 |
| 5,595,414 | A | | 1/1997 | Dulnig et al. | |

FOREIGN PATENT DOCUMENTS

| | | |
|---|---|---|
| DE | 36 05 628 A1 | 8/1987 |
| DE | 43 19 851 A1 | 12/1994 |
| DE | 297 00 448 U1 | 3/1997 |
| DE | 297 22 516 U1 | 6/1998 |
| DE | 197 07 110 A1 | 9/1998 |
| FR | 2 141 511 | 6/1971 |

OTHER PUBLICATIONS

Sep. 12, 1999, International Search Report.

* cited by examiner

*Primary Examiner*—Carl D. Friedman
*Assistant Examiner*—Steve M Varner
(74) *Attorney, Agent, or Firm*—Merchant & Gould P.C.

(57) ABSTRACT

The object in form of a cone, for the sale of ice containing a freezer, a sunshade and a chair is a self-standing object for the sale of ice on public grounds, or in its smaller version for indoors. It contains all necessary elements for an ice-cream stand. On top of the object there is a lamp and in the central third of the cone there are four flexible wings, which form in open position a sunshade. Between the wings an awning is spread. In the lower part of the cone, there is a classical freezer for ice-cream built in. The chair, which is also in form of a cone can be opened and its interior used as a waste paper basket. The outside surfaces of both the cone and the chair are decorated with advertisements.

8 Claims, 10 Drawing Sheets

Figure 1:
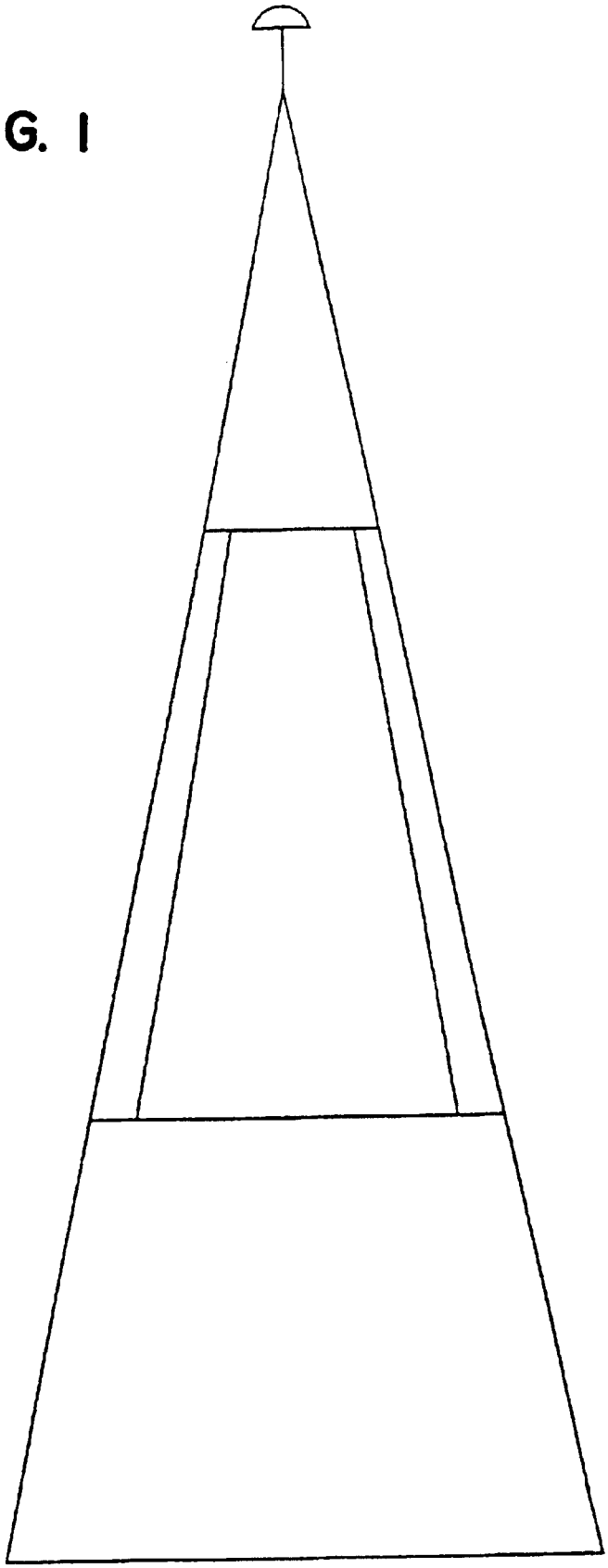
Figure 2:
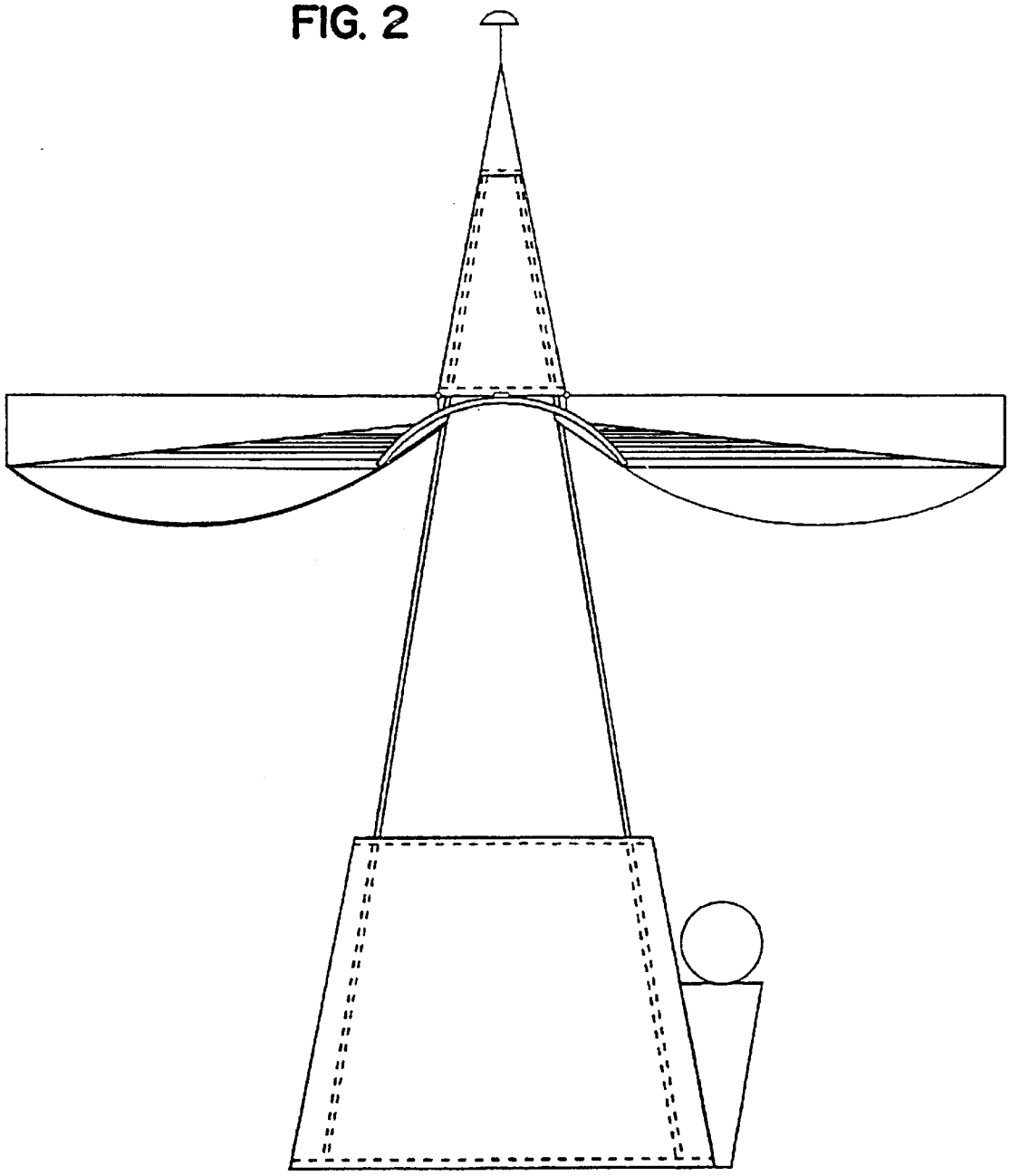
Figure 3:
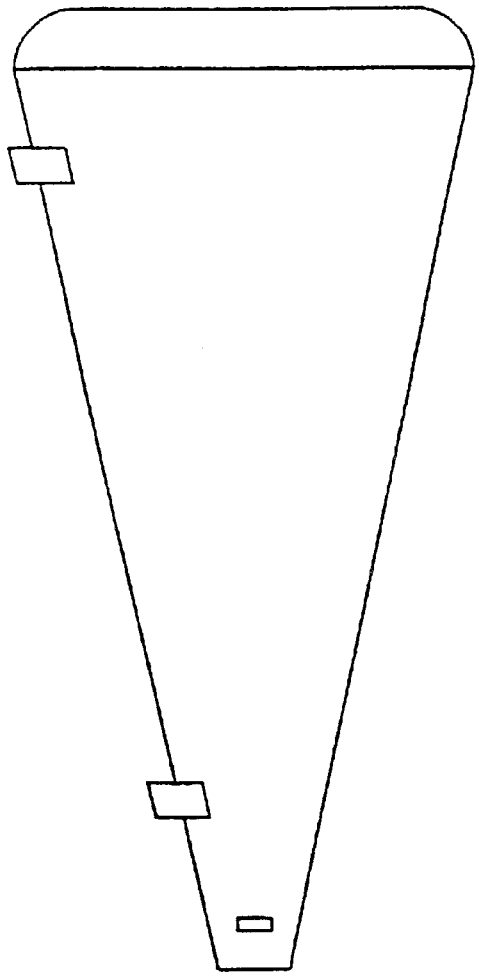
Figure 3A:
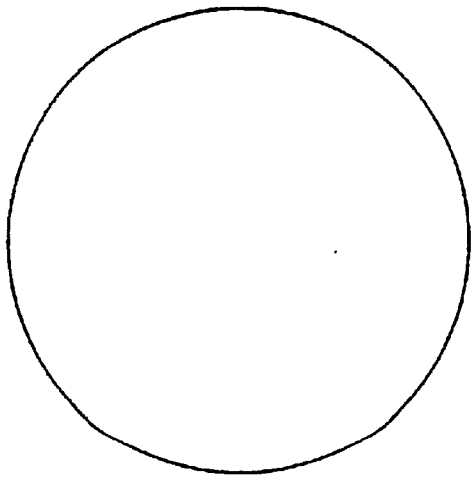
Figure 4:
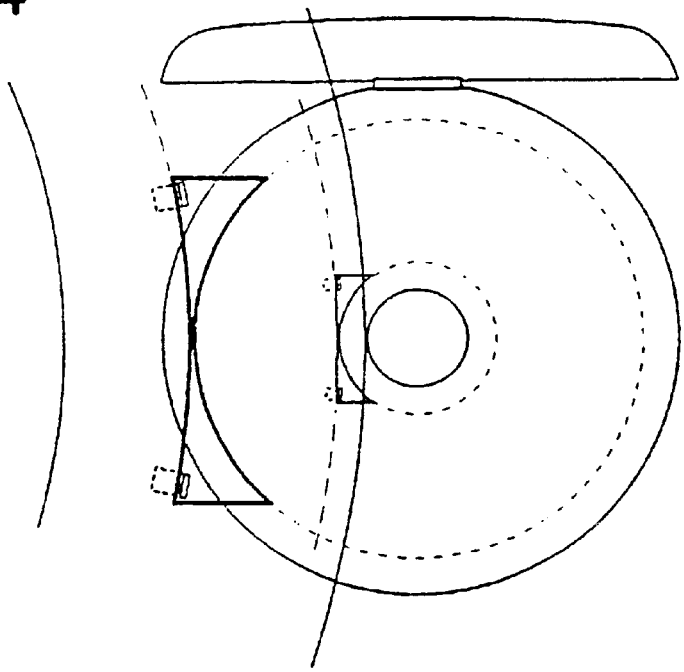
Figure 4A:
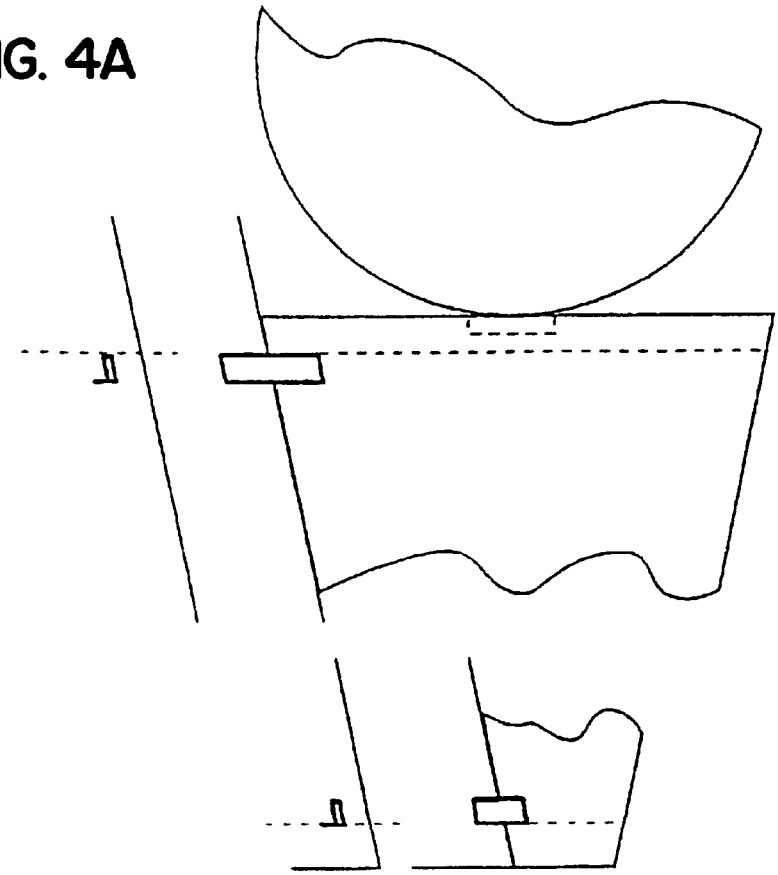
Figure 5:
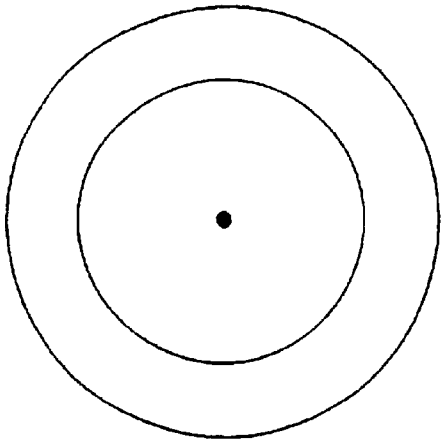
Figure 5A:
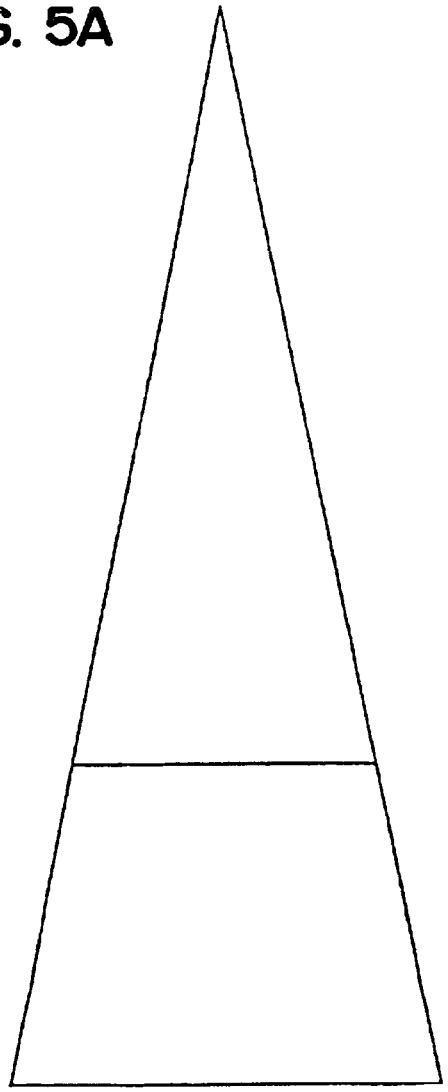
Figure 6:
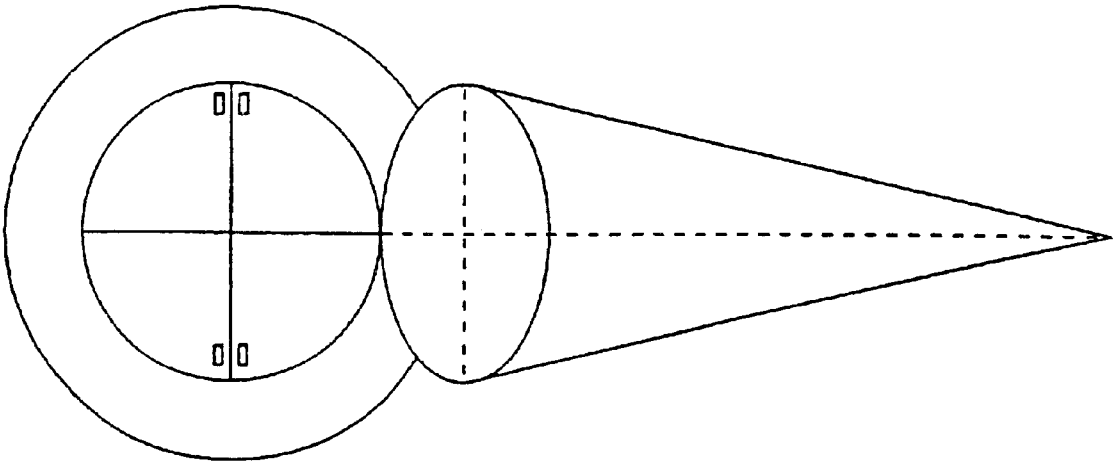
Figure 6A:
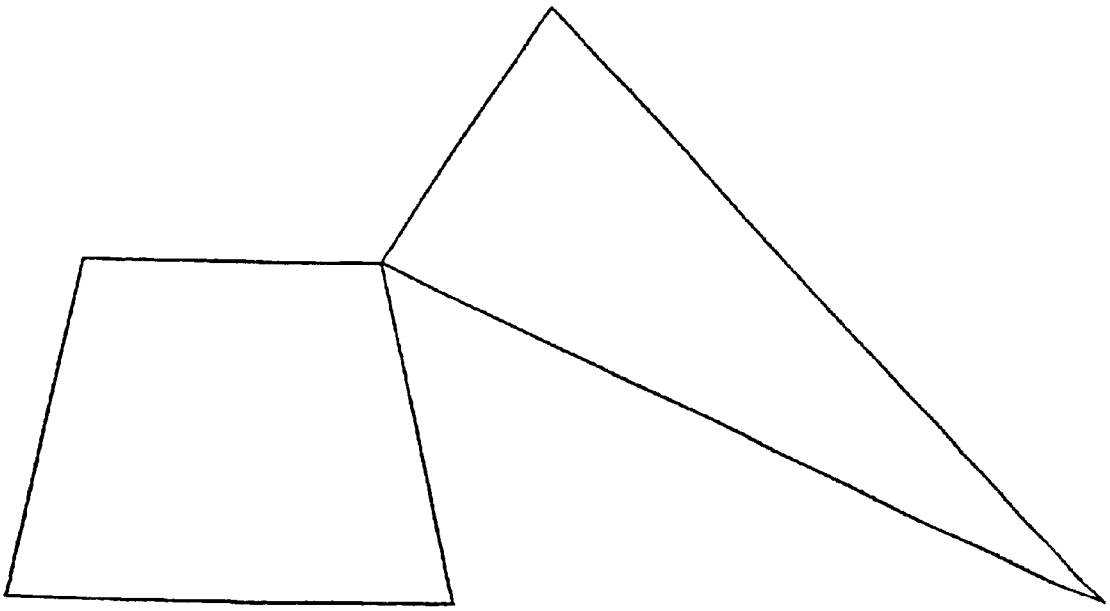
Figure 7:
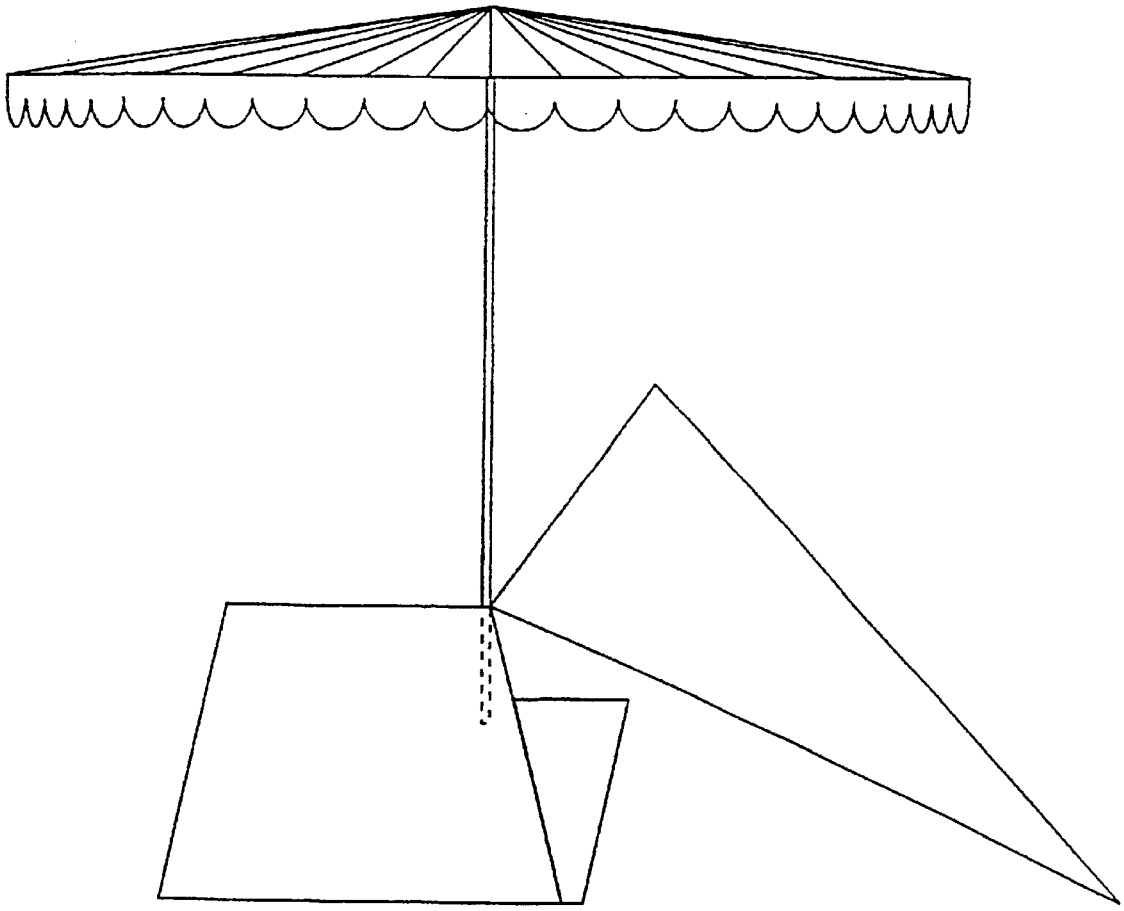
Figure 8:
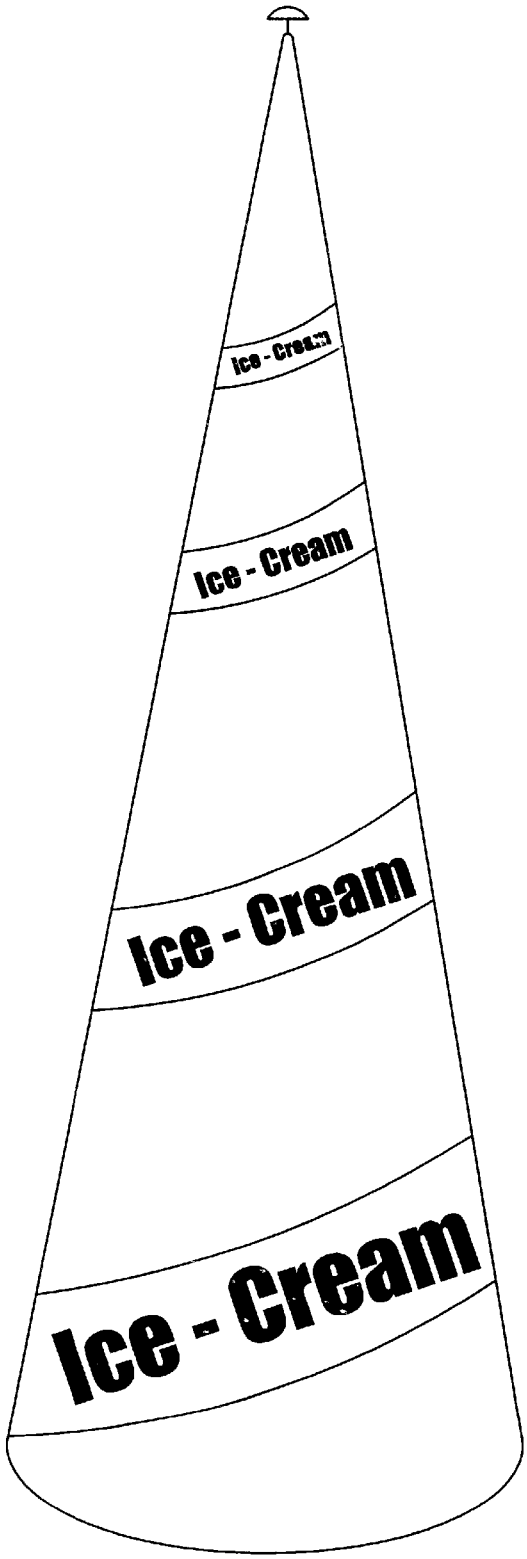
Figure 9:
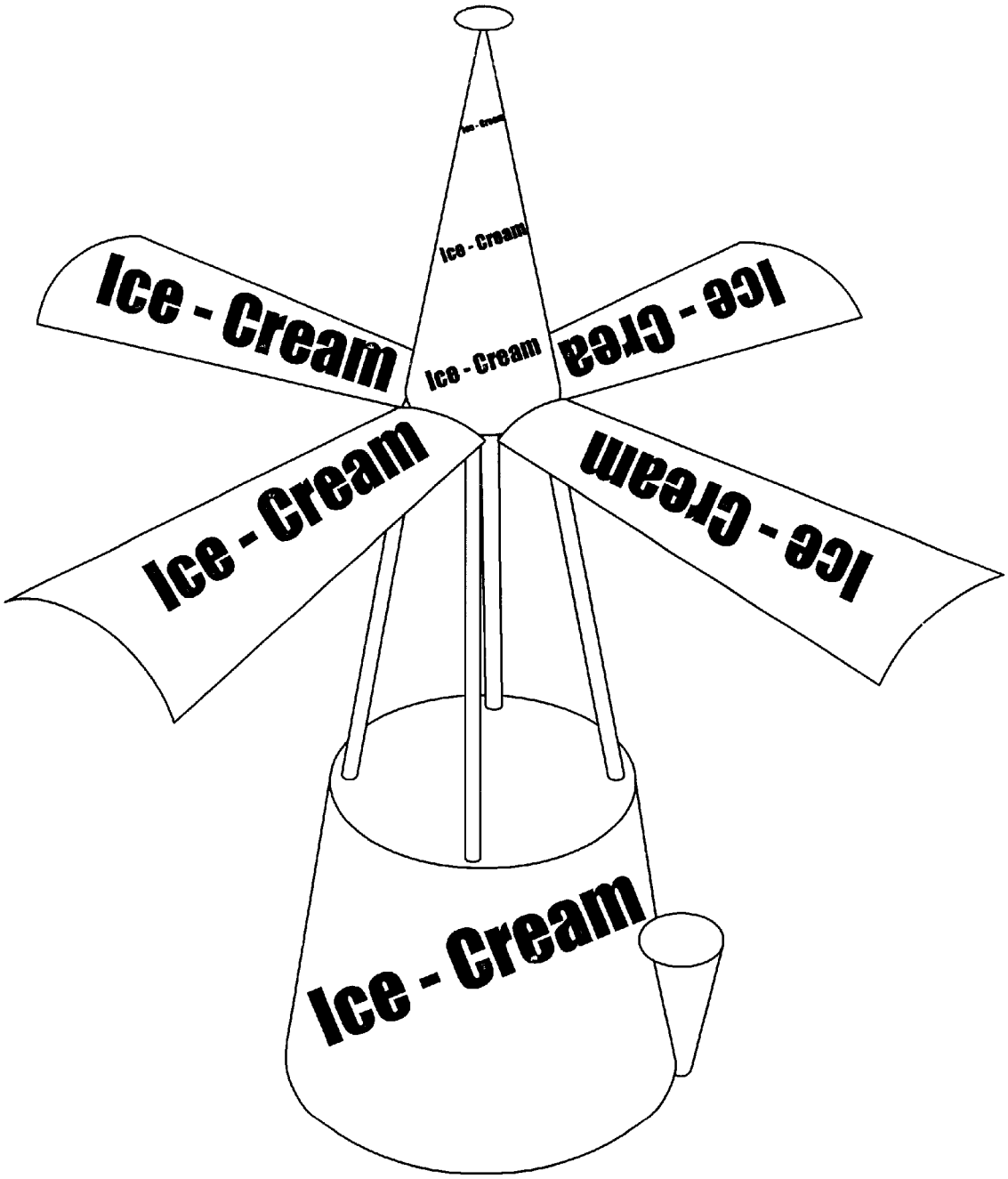
Figure 10:
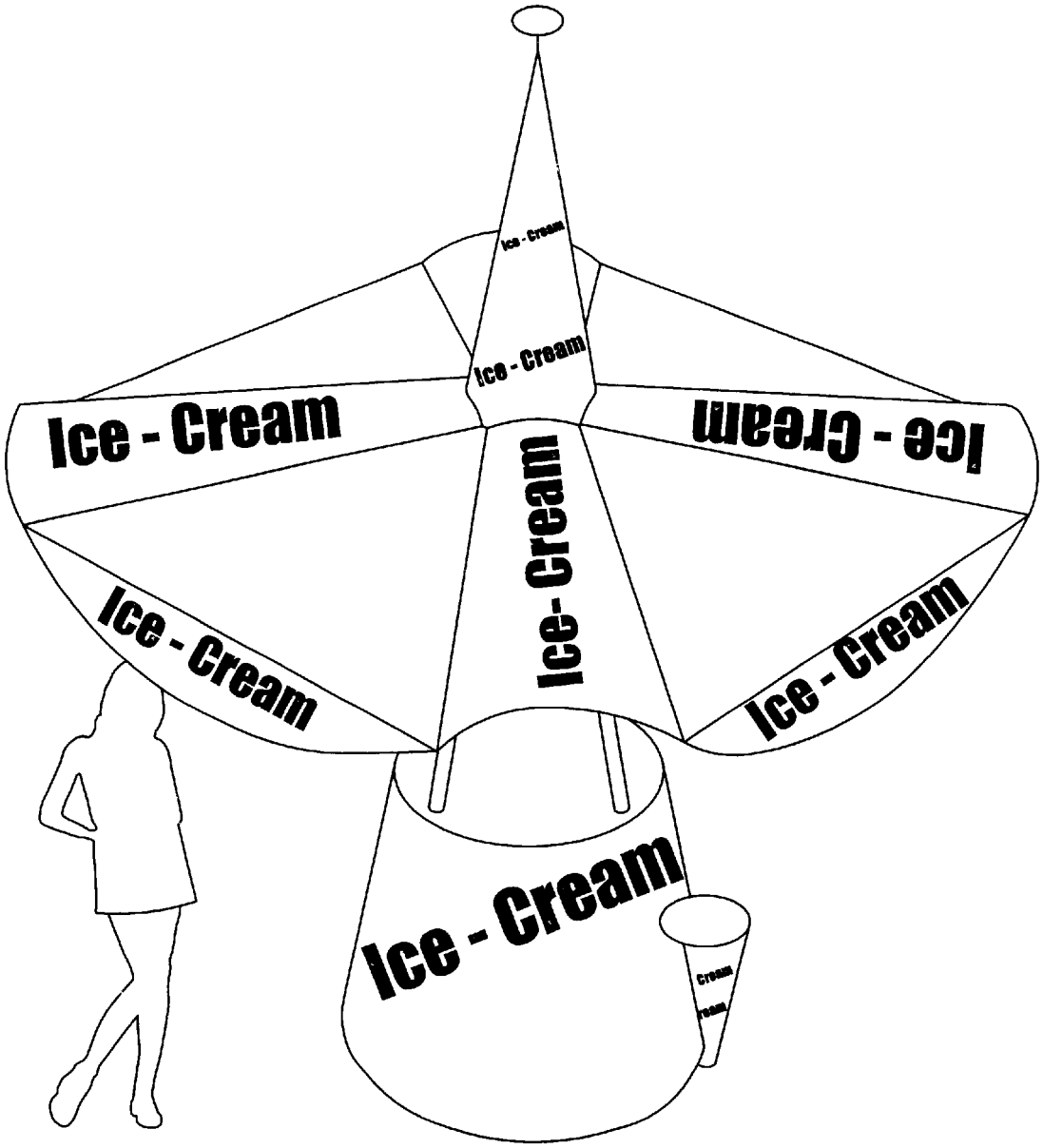

MARKETABLE OBJECT FOR SELLING ICE CREAM, WITH REFRIGERATING SHOWCASE, SUNSHADE AND CHAIR

DESCRIPTION OF INVENTION

Type of Invention

This invention concerns the manufacture of an object (stand) that comprises an ice-cream stand with a freezer, sunshade, chair and paper basket, illumination—all built into one body and in form of a cone when the stand is closed for version A and an ice cream stand for indoor facilities containing only a freezer built into the object in form of a cone for version B. According to the international classification the invention is classified as: A 47 F.

2. TECHNICAL PROBLEM

Version A

Ice cream stands for outdoor sales of ice are usually made very complicated, because all elements are separate—freezer (showcase), chair, sunshade and the waste paper basket, so that when the stand closes, all these elements have to be stored somewhere in a separate storage facility or the seller have to carry some of this equipment with them.

Version B

Ice cream, stands in large shopping centres and supermarkets can be more visible, attractive and sight-catching if the freezer is built within the stand itself, which is of a cone form, e.g. an upside-down turned ice-cream cone, with its outside decorated with the symbols, advertisements of the respective product.

3. STATUS OF TECHNICAL

Version A

In the present situation at street stands we will find a large freezer of a quadrate or rectangle shape, or a quadrate shape box in which the freezer is positioned in. The seller has to bring the chair or to put it into a separate, additional box or storage facility, as well as the sunshade and the waste basket. . . . It is locked with several locks and very often with complicated metal covers.

Version B

Ice cream stands in large shopping centres and supermarkets are not pointed out enough, because they are usually placed near to other freezers-showcases, in which a variety of other products is offered and since ice-cream is a seasonal product it would be necessary to highlight the ice cream stands. With our stand n cone form we would achieve exactly that.

4. EXPLANATION OF THE BASICS OF THE INVENTION

Version A

The primary goal is to unify all elements that are necessary for a street stand that sells ice-cream into one unit in a cone form.

The cone, as a single object contains all necessary elements for a complete ice-cream stand, so when this object is opened all elements for normal work show—like freezer, sunshade chair, waste paper basket and on top of the stand—cone there is a light that illuminates the cone from the outside at nights. See drawings S1. 2, s1. 10

When the object is closed, than it is in form of a cone (upside down ice-cream cone) and on the entire outside the object is decorated with marketing and propaganda material (pictures, drawings, advertisements etc.) so it has an additional, advertising function. See S1. 1 and s1. 8.

Version B

In this version the above object is also of a cone shape with a certain height, which folds in the mid and opens. In the lower part there is a freezer and the upper part is used as a cover, when open ice-cream can be taken out, when closed the entire outside surface is decorated with advertising material of the ice cream contained within the cone.

As an option on Version B a moveable sunshade can be attached, in case the cone is placed outside the supermarket or shopping centre during the day and to put it inside during nights. In such a case the sunshade is not part of the cone, but has to be mounted or disassembled every time when used. See S1. 5, 6 and 7.

5. SHORT DESCRIPTION OF THE DRAWINGS/SKETCHES

The attached drawings/sketches show the best way of manufacturing the invention and of course help when explaining the basic principles of the invention,

Version A

Drawing S1. 1: when the object is closed shows a cone shape (upside-down ice-cream cone) with a light on top—so at night it represents a large illuminated cone (ice cream cone). See S1. 1 and 8.

Drawing S1. 2: when the object is open (working hours) it turns into an ice-cream stand with a freezer (showcase) and the sides/flanks in form of "wings" become a sunshade. In the lower part a chair is positioned which is also of a cone form. See S1. 3, 3*a*, 4, 4*a*.

When the stand (object) is opened, between the open wings an awning is attached, so it has the function of a sunshade and protects of rain. The awnings can be used for advertisements too. See S1. 10.

Drawing S1. 8:—when the object is closed than the entire surface is decorated with advertisements of the ice-cream sold at the stand.

OPENING OF THE OBJECT

The top third of the object maintains the form of an ice-cream (cone) and is used for advertisements;

- the medium third, which is actually divided into four parts ("wings") forms a sunshade above the lower part when opened;
- the lower third (the widest part of the cone) contains a freezer for the ice-cream that is sold;
- at the outer part of the lower third of the object, in drawing S1. 2 (during working hours) a chair is mounted for the seller which is also of a cone form (see drawings—S1. 3, 3*a*, 4 and 4*a*) and within the chair a waste paper basket is built in. Off working hours, the chair is placed into the central part of the closed object.

Version B

Drawing S1. 5 and 5*a*: represents the object when closed, in form of a cone, cut in its lower third in which the freezer is positioned, while the upper part has only the function of a cover. The entire object is decorated with advertisements.

Drawing S1 6 and 6*a*: represents the object in open position where the lower part in which the freezer is placed is visible, while the upper part is attached only at one spot (its moveable) and used as a cover.

Drawing S1. 7 represents the object in open position with a sunshade. This sunshade is optional and is not part of the object, so its has to be mounted separately. This version with the shade is used when the stand is positioned on terraces of hotels, restaurants or similar or outside shopping centres or supermarkets where the seller mustn't sit all the time next to the stand.

6. DETAILED DESCRIPTION OF AT LEAST ONE WAY OF MANUFACTURING THE INVENTION

Version A

This invention that is illustrated on the attached drawings, will be manufactured of metal or plastic in form of a cone, which represents at the same time an upside down ice-cream cone, with a height of 3 metres. On top of the cone a lamp is attached, the mid third opens into four wings that are used as shades and that are connected with each other by an awning. In closed position this part is used for storage of the chair. In the lower part the freezer is mounted. During working hours the chair, which is also cone shaped, is mounted to the object and used when opened as a waste paper basket. The outside surfaces of the cone, when it is closed are decorated with advertisements of the respective ice-cream producer. The chair is also decorated from its outside with advertisements.

Version B

The object is manufactured in the same way as above, but it consists of only two parts, a lower one with a freezer and an upper one as cover. The outside is again decorated with advertisements. This version is used when the stand is positioned on terraces of hotels, restaurants or similar or outside shopping centres or supermarkets where the seller mustn't sit all the time next to the stand.

7. APPLICATION OF THE INVENTION

Version A

The basic usage of the invention is sales of ice-cream outdoors (street stand). The invention presents a practical, permanent and useful object, that solves economically and within one unit, all elements of an ice-cream stand. Its shape gives an attractive surface for advertisements of the ice-cream producer and its shade gives protection against the sun to the ice-cream seller and the stand itself. On top of the object there is a lamp which illuminates the cone, a chair which is also of a cone shape and a waste paper basket.

The object itself can be adjusted in size and be used for outdoors or indoors (simple version without shades, chair and illumination).

Version B

The invention allows easy and practical sale and propaganda of the ice-cream sold, because the entire object (upside down ice-cream cone) looks very attractive, especially among different other showcases, freezers, stands and products. The freezer is built into the cone itself, the upper part is closed—in order to isolate the freezer better. The dimensions of the cone can be adjusted to the requests of the customers. The object can be used for in- or outdoor sale of ice, in or outside large supermarkets or shopping centres or hotels and restaurants.

What is claimed is:

1. A structure for the sale of ice-cream, the structure comprising:

a housing having a first configuration in which the housing is shaped substantially as a geometric cone having a substantially circular bottom, a substantially pointed top, and a uniformly inclined exterior surface between the substantially circular bottom and the substantially pointed top, and a second configuration in which the housing deviates from the geometric cone shape;

the housing includes a frusto-conical base section with the substantially circular bottom and an interior space, an intermediate section, and an upper section with the substantially pointed top;

the base section contains a freezer for ice-cream; and the intermediate section comprising a plurality of wing members that are pivotally mounted to a lower end of the upper section so as to be moveable between a first position when the housing is in its first configuration and a second position when the housing is in its second configuration, the wing members are arcuate in an end plan view, and at the first position the wing members are contiguous with each other and combine together to form a frusto-conical portion of the exterior surface, and at the second position the wing members project from the housing and are substantially not contiguous with each other to permit access to the interior space of the base section.

2. A structure according to claim 1, further comprising a lamp on the upper section adjacent the substantially pointed top.

3. A structure according to claim 1, further comprising a cone-shaped chair having an outer surface and connectors on the outer surface, and the base section includes receptacles that are positioned and shaped to receive the connectors on the chair whereby the chair can be attached to the base section.

4. A structure according to claim 3, wherein the chair includes an upper end and a bottom end, and the outer surface tapers from the upper end to the bottom end, the chair further includes an interior space, and further comprising a lid pivotally attached to the upper end of the chair, the lid being pivotally moveable between a first position at which the lid covers the interior space of the chair to prevent access to the interior space of the chair and a second position at which the lid does not cover the interior space of the chair to permit access to the interior space of the chair.

5. A structure according to claim 1, wherein comprising an awning extending between the wing members when the wing members are at the second position.

6. A structure for the sale of ice-cream, the structure comprising;

a housing having a first configuration in which the housing is shaped substantially as a geometric cone having a substantially circular bottom, a substantially pointed top, and a uniformly inclined exterior surface between the substantially circular bottom and the substantially pointed top, and a second configuration in which the housing deviates from the geometric cone shape, the housing includes a frusto-conical base section with the substantially circular bottom and an interior space, and an upper section with the substantially pointed top;

the base section contains a freezer for ice-cream; and the upper section is pivotally connected to the base section so as to be moveable between a first position when the housing is in its first configuration and a second position when the housing is in its second configuration, and the upper section extends from the side of the base section at the second position to permit access to the interior space of the base section.

7. A structure according to claim 6, further comprising a cone-shaped chair having an outer surface and connectors on the outer surface, and the base section includes receptacles that are positioned and shaped to receive the connectors on the chair whereby the chair can be attached to the base section.

8. A structure according to claim 7, wherein the chair includes an upper end and a bottom end, and the outer surface tapers from the upper end to the bottom end, the chair further includes an interior space, and further comprising a lid pivotally attached to the upper end of the chair, the lid being pivotally moveable between a first position at which the lid covers the interior space of tho chair to prevent access to thy interior space of the chair and a second position at which the lid does not cover the interior space of the chair to permit access to the interior space of the chair.

* * * * *